United States Patent [19]

Nichols et al.

[11] 4,435,969

[45] Mar. 13, 1984

[54] SPIN-FLANGER FOR BEVERAGE CONTAINERS

[75] Inventors: C. Ross Nichols, Golden; Edward C. Miller, Broomfield, both of Colo.

[73] Assignee: Ball Corporation, Muncie, Ind.

[21] Appl. No.: 269,446

[22] Filed: Jun. 2, 1981

[51] Int. Cl.[3] ..... B21D 19/12

[52] U.S. Cl. ..... 72/126; 72/117; 72/123

[58] Field of Search ..... 72/84, 112, 115, 117, 72/118, 119, 120, 123, 124, 125, 126

[56] References Cited

U.S. PATENT DOCUMENTS

| | | | |
|---|---|---|---|
| 440,474 | 11/1890 | Farris | 72/125 |
| 545,791 | 9/1895 | Gates | 72/124 |
| 944,791 | 12/1909 | Krummel | 72/117 |
| 1,055,571 | 3/1913 | Tassey | 72/125 |

FOREIGN PATENT DOCUMENTS

| | | | |
|---|---|---|---|
| 374913 | 5/1923 | Fed. Rep. of Germany | 72/126 |

*Primary Examiner*—Lowell A. Larson

*Attorney, Agent, or Firm*—Gilbert E. Alberding

[57] ABSTRACT

An apparatus and method are disclosed for flanging thin-walled canbodies. Slippage in the circumferential direction between the canbody and flanging apparatus is severely reduced by mounting rollers in the flanging head on radial axis of rotation which are perpendicular to the longitudinal axis of the canbody. This roller orientation provides a number of other advantages including lowered incidence of defective flanges, reduced maintenance of the roller, reduced cost and complexity in roller and mounting means fabrication and a reduction in the strain and stress the canbody is subjected to. Critical to satisfactory commercial operation of the present invention is the provision of and the proper interaction between a transition and clearing surface and a frustoconical support surface on the rollers.

11 Claims, 3 Drawing Figures

SPIN-FLANGER FOR BEVERAGE CONTAINERS

TECHNICAL FIELD

This invention relates to the art of can manufacturing and more particularly, to the flanging outward of the end portion of canbodies. Although this invention is particularly applicable to canbodies and will be described with reference thereto, it is to be appreciated that the invention has broader application and may be used for flanging other hollow thin-walled cylindrical bodies that are subject to plastic deformation such as conduit, drums or the like.

BACKGROUND ART

The open end of canbodies is commonly reduced in diameter and flanged. The flange facilitates attaching a closure to the end and the reduction in diameter allows using a smaller closure thereby saving material. Furthermore, reducing the diameter does not substantially decrease the volume of the can.

In a production line situation, cans are commonly reduced in diameter by being forced into a tapered necking die. The end of the can is then flanged outward by a plurality of flanging rollers mounted on a flanging head.

A major source of defective cans, the split flange, results from this necking and flanging operation. During the formation of the can, substantial strain hardening takes place. A further reduction in ductility results from the necking operation. When radial forces are then applied to the neck in the flanging operation, cracking and wrinkling may occur.

As noted above, conventional flanging heads carry a plurality of rollers. These rollers are mounted with the axis of rotation parallel to the canbody's longitudinal axis and the head is likewise rotatably mounted. The rollers are uniform in design and have a small diameter at the end which first enters the canbody and a gradually increasing diameter which forms the flange. An example of conventional rollers may be found in FIGS. 2 and 4 of U.S. Pat. No. Re. 30,144 Gnyp, et al.

These conventional rollers have a number of problems. In operation their tapered shape wipes or wedges the canbody outward by longitudinal and rotational motion relative to the canbody. The high forces required for this operation result in frequent maintenance of the rollers. As the rollers must sustain axial loading, the design is somewhat complex and difficult to dismantle and repair. The high forces placed on the canbody may cause defects in other portions of the canbody than the flange, such as scratching of coating off the bottom where the canbody is supported.

Further, as should be apparent to one skilled in the art, the conventional roller configuration shown in Gnyp, et al. results in some relative motion between the rollers and the canbody over a major portion of the contact areas. It is thought that the portion of the roller supporting and contacting the neck rolls without slippage around the neck of the canbody. The outer portion of the roller must then travel at a considerably greater speed resulting in slippage and the generation of frictional forces in the circumferential direction over the area being flanged. These frictional shear forces are thought to weaken the metal and significantly contribute to the problem of defective cans.

The present invention relates to a new and simpler design of head and roller configuration which minimizes shear forces by reducing circumferential slippage between the roller and the canbody over the total contact area and substantially reduces the forces which the canbody is subjected to thereby reducing maintenance and other defects in the canbody.

SUMMARY OF THE INVENTION

The present invention relates to a simplified roller and head design which minimizes the shear forces generated by contact between the canbody and the roller. Ideally, flanging would be accomplished by placing the canbody solely in tension until sufficient plastic deformation occurs to form the desired flange configuration. Practically, in physically applying the required tensile forces, some frictional shear forces will also be generated.

In accordance with the present invention, a new roller orientation severely reduces or eliminates the generation of frictional forces in the circumferential direction between the canbody and the rollers while the specially designed rollers provide longitudinal support to and clearance of the canbody. This reduction of forces greatly reduces maintenance of the rollers and canbody defects in areas other than the flange.

Further, flanges formed in accordance with the present invention are observed to have substantially reduced internal stresses compared to flanges formed in accordance with the above described prior art devices. This may be demonstrated by carefully severing the flange from the canbody. Flanges formed in accordance with the present invention retain their flanged configuration and lay flat on a planar surface. Flanges formed in accordance with the prior art, when severed, severely distort indicating the presence of a high level of internal stress. It is not completely understood why the internal stresses are greatly reduced with the present invention; however, it is thought that the lowered overall forces required in flanging a canbody and the reduced frictional forces both contribute to this result.

In the present invention, the rollers are mounted on axes of rotation which extend outward from the center of the flanging head. Each roller's axis of rotation is perpendicular to the longitudinal axis of the canbody in contrast to the parallel axis of rotation of prior art rollers. Essentially, the rollers ride on the canbody end similar to the way a railroad wheel rides on a rail. This allows the complete contact area of the roller and the canbody to be in synchronization with respect to circumferential motion. Rather than wedging the canbody outward into a flange, the present invention allows a much easier rolling motion.

Critical to the present invention is the shape of the rollers so that proper longitudinal support is imparted to the canbody. The rollers are designed with an arcuate concave forming surface around the inner diameter. Immediately outward of the forming surface and integrally connected thereto is a frustoconical slack-removing and supporting surface. This surface supports the canbody and aids in preventing buckling when flanging. A convex transition and clearing surface of a very small radius is outward and integrally connected to the frustoconical support surface. The interrelation between this transition surface and the frustoconical surface is critical. Should the transition surface not provide sufficient clearance, the leading edge of the roller may contact and stretch the canbody during flanging. Should the clearance be too great, the canbody will receive insufficient support resulting in a high incidence of buckling when flanging. When using rollers of the design herein described, the close-to-ideal situation of applying solely tensile forces to the canbody is achieved by limiting the roller-canbody contact area to an extremely narrow strip parallel to the longitudinal axis of the canbody.

Accordingly, it is an object of this invention to reduce the incidence of defective flanges in a can manufacturing production line.

It is a further object of this invention to provide an apparatus and method for flanging canbodies with a greatly increased life relative to conventional flanging heads.

It is a further object of this invention to provide a simplified apparatus for flanging canbodies which is easy to maintain and repair.

It is a further object of this invention to reduce the stress canbodies are subjected to during flanging and thereby reduce the incidence of damage to canbodies.

It is a further object of this invention to eliminate or minimize the relative circumferential movement between the canbody and the flanging rollers.

It is a further object of this invention to minimize the residual internal stresses in the flange of a canbody.

DETAILED DESCRIPTION OF A PREFERRED EMBODIMENT

Figure 1:
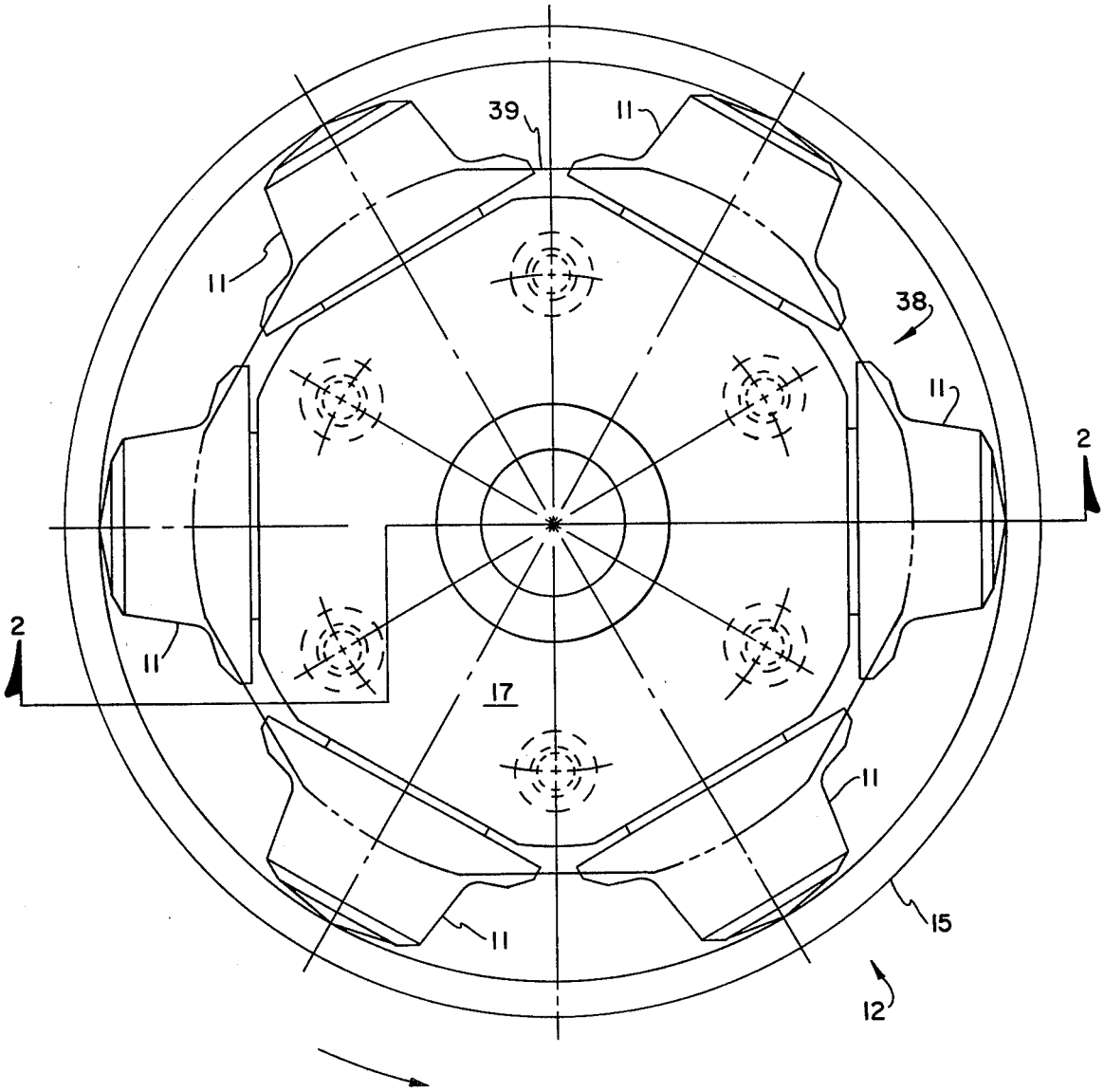
FIG. 1 is an end view of a flanging head constructed in accordance with the present invention.

While this invention is susceptible of embodiment in many different forms, there is shown in the drawings and will herein be described detail, one specific embodiment, with the understanding that the present disclosure is to be considered as an exemplification of the principles of the invention and is not intended to limit the invention to the embodiment illustrated.

Figure 2:
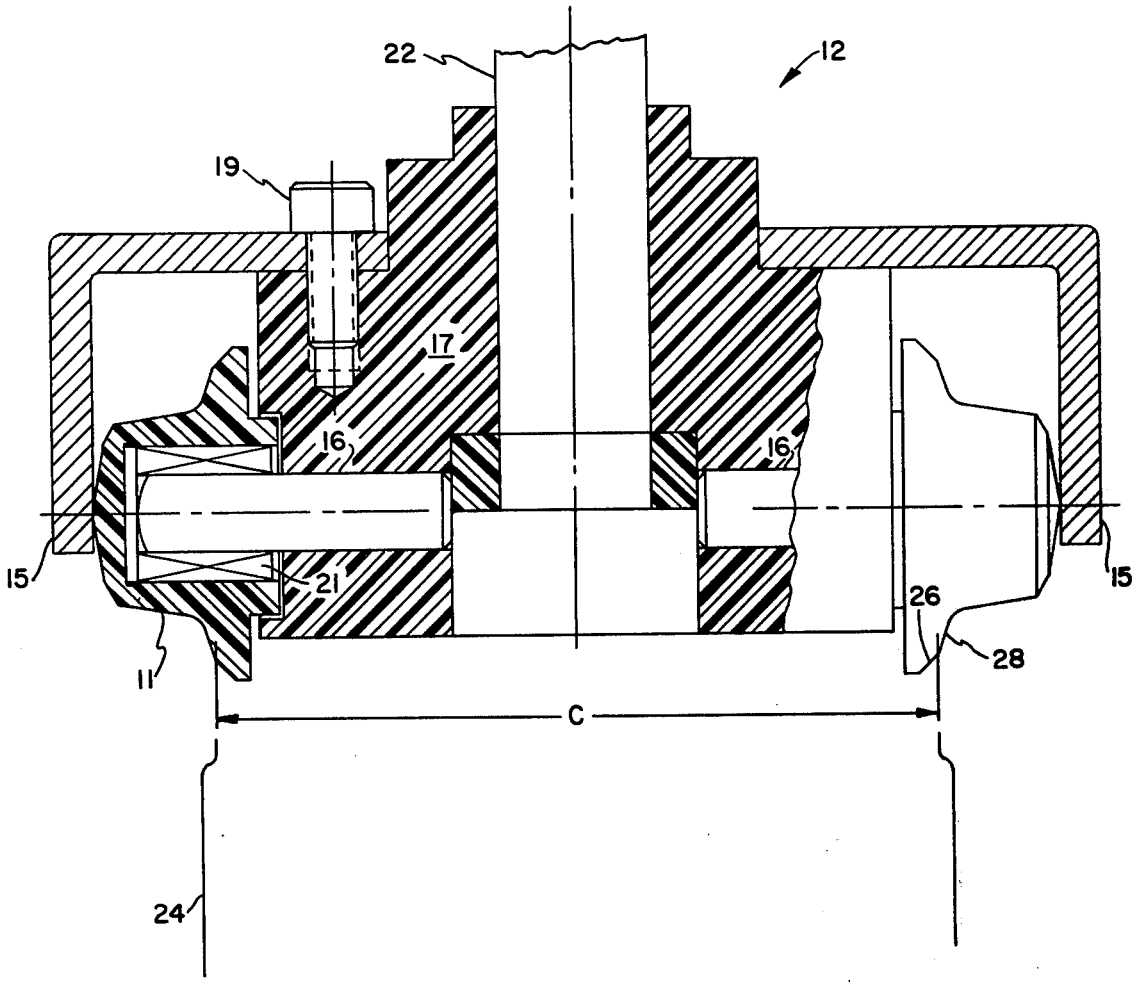
FIG. 2 is a cross-sectional view of the apparatus of FIG. 1.

Referring to FIG. 1, a flanging head 12 which is constructed in accordance with the present invention is illustrated. The flanging head has a body 17 with a plurality of radially located rollers 11. As shown in FIG. 2, these rollers are mounted with bearings 21, on a plurality of mounting shafts 16. A retainer 15, is secured to flanging head body 17 by a plurality of bolts 19. The retainer locks rollers 11 onto mounting shafts 16 yet allows for quick and easy removal of the rollers should repair or maintenance be required.

Figure 3:
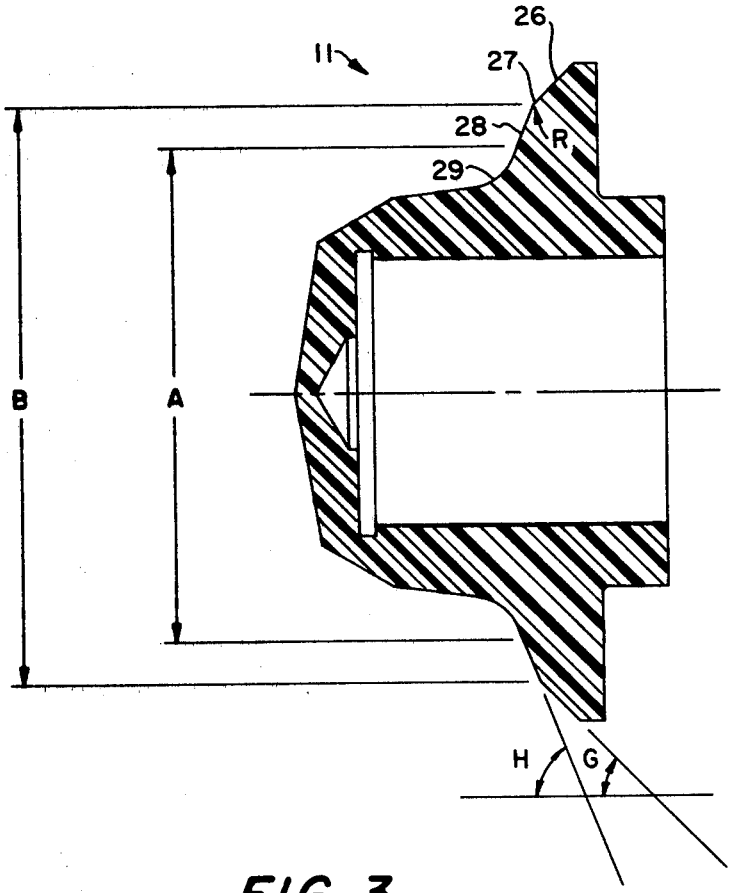
FIG. 3 is a cross-sectional view of a single roller used in the preferred embodiment.

A cross-sectional view of a roller 11 is shown in FIG. 3. The roller has a frustoconical guiding surface 26, a curved transition and clearing surface 27, a frustoconical supporting and slack-removing surface 28 and a forming surface 29. An essential feature of the present invention is the orientation of the rollers relative to the canbody as shown in FIG. 2. The rollers rotate on axes which are perpendicular to the canbody's longitudinal axis.

Referring to FIG. 1, the terminal edge 38 of a canbody is shown immediately after coming into contact with rollers 11. As is well appreciated in the art, the contact of the extremely thin-walled metal container at a plurality of points around the circumference results in an elastic deformation on the container from its circular shape to a plurality of almost straight shaped portions 39, between said contact points. This provides some slack and inhibits the plastic deformation of the end of the canbody to the desired configuration.

A further result of this elastic deformation, which may be observed in FIG. 1, is that the straight sections 39 are closer to the leading and trailing edges of the rollers than would otherwise be the case if the canbody retained its circular shape. This does not provide a significant problem with the trailing edges of the rollers for the canbody will be flanged prior to passing said trailing edges. The leading edges of the rollers, however, may contact the unflanged canbody end as the flanging head is fed down into the can. Should such contact occur, the downward motion of the leading edges of the rollers could cause wrinkling of the canbody and upon flanging, result in cracks or other defects in the flange.

One method of eliminating such detrimental contact is to decrease angles H and G of FIG. 3 such that only the actual forming surface 29 contacts the can. However, such action would eliminate the longitudinal support which is provided by surfaces 27 and 28 resulting in buckling of the canbody upon feeding the rollers therein.

In accordance with the present invention, the roller is shaped to provide support to the canbody yet clear the portion of the canbody passing by the leading edge of the roller. The contact area between the canbody and the roller is limited to a thin narrow strip in the longitudinal direction, thereby providing the necessary support in the longitudinal direction of the canbody yet allowing clearance of the leading edge of the roller. This support is necessary because substantial longitudinal forces are generated in forcing the rollers into the canbody to provide the flange.

The necessary support and clearance are provided by the interaction of surfaces 27 and 28. It has been found that in the preferred embodiment, which is used for flanging thin-walled metallic containers having a sidewall thickness of between about 0.003 and 0.008 inches and a necked diameter of between about 2.36 inches and 2.46 inches, surface 27 must have a radius R of between about 0.300 and 0.060 inches, and preferably about 0.110 inches. Referring to FIG. 2, the distance C, which is measured between two opposed rollers at the intersect point of extensions from surfaces 28 and 26, must be between about the 2.36 and 2.46 inches of the container diameter such that the container first contacts surface 27 in the flanging operation. As shown in FIG. 2, the diameter of the necked-in portion of the canbody and distance C are preferably about the same.

It has been found that when the radius of curvature of surface 27 is greater than 0.300 inches, buckling of the canbody is much more likely to occur due to lack of support. If the radius of surface 27 is less than 0.060 inches, wrinkling of the canbody is much more likely to occur. This wrinkling is thought to result from contact of the leading edge of the roller with the canbody thereby stretching the canbody such that upon flanging, wrinkling and cracking occur.

Critical support to the canbody during flanging is also provided by frustoconical surface 28 which is at an angle of inclination referenced H with the axis of the roller 11. In the preferred embodiment, H is between about 60 and 75 degrees or preferably, 68 degrees. Frustoconical surface 26, which is at an angle of G with the axis of roller 11, provides only a guiding function. It is not thought to be critical other than it must clear the canbody at the leading edge of the roller. In the preferred embodiment, G is about 45 degrees.

The other two dimensions which define the configuration of roller 11 of the preferred embodiment are distance A and B in FIG. 3. Dimensions A is the diameter of the intersect point of surfaces 28 and 29 while dimension B is the diameter of the intersect point of extensions from surfaces 26 and 28. In the preferred embodiment, distance A and B are respectively about 0.80 and 0.92 inches.

It should then be appreciated, that in its broadest aspect, the present invention contemplates a plurality of rollers mounted in a flanging head on radii from a center point. The rollers are specially designed to provide support over a longitudinal contact area yet clearance of the canbody's terminal edge with the leading edge of the rollers. This is accomplished by providing the rollers with a clearing and transition surface having a convex annular shape and a small radius of curvature, a generally frustoconical support and slack removing surface, and a concave forming surface of the desired flange shape. In the preferred embodiment for flanging thin-walled metallic containers having a diameter of between 2.36 and 2.46 inches, it has been found that the radius of the clearing and supporting surface is critical and must be between about 0.300 inches and 0.060 inches or preferably, about 0.110 inches.

What is claimed is:

1. A roller for flanging canbodies comprising:

an annular arcuate forming surface;

a first frustoconical slack-removing and supporting surface integrally connected to said arcuate forming surface and forming an outside angle of from about 60° to about 70° with respect to the central axis of the rotor; and an annular curved surface with a radius of less than about 0.300 inches and greater than about 0.060 inches for providing clearance of the canbody, said annular curved surface being integrally connected to said first frustoconical surface.

2. The roller of claim 1 further comprising a second frustoconical surface for guiding the canbody and integrally connected to said annular curved surface.

3. An apparatus for flanging thin-walled cylindrical members which minimizes residual internal stresses in the flange, comprising:

a rotatable body having six rollers, each roller having an annular curved surface with a small radius for clearing the canbody, a frustoconical supporting and slack-removing surface integrally connected to said annular curved surface and adapted to engage a significant portion of the thin-walled cylindrical member and an annular arcuate forming surface integrally connected to said frustoconical surface; and mounting means for said six rollers such that said rollers are mounted on six radially directed axes equally spaced about the axis of rotation of said body.

4. A flanging head which minimizes circumferential slippage between the rollers and the canbody over the total contact area, comprising:

a plurality of rollers rotatably mounted on radial axes of rotation that are equally spaced on the flanging head about its central longitudinal axis of rotation; each roller having a curved annular surface with a radius between about 0.300 inch and about 0.060 inch for initially contacting the can and for providing rapid clearance of the outer diameter portion of said roller from the canbody, a frustoconical support surface integrally connected to said curved annular surface for supporting the canbody, and an arcuate forming surface integrally connected to said frustoconical support surface for plastically deforming said canbody into the desired flanged configuration, the number of said plurality of rollers being such that their frustoconical support surfaces collectively engage a major portion of the periphery of the open end of the canbody.

5. The flanging head of claim 4 wherein each roller further includes a frustoconical guiding surface integrally connected to said curved annular surface for guiding said can onto said rollers.

6. A roller for use with a plurality of like rollers for flanging canbodies, comprising:

a frustoconical guiding surface;

a curved annular transition surface having a radius of about 0.110 inches for initially supporting the canbodies' sidewall and allowing clearance between the roller and the unflanged sidewall during entering and exiting the canbody;

a frustoconical supporting and slack-removing surface integrally connected to said curved annular transition surface for providing support to canbody sidewall adjacent the portion being flanged; and an arcuate annular forming surface integrally connected to said frustoconical supporting surface.

7. A flanging roller for use with a plurality of like rollers for mounting on radial axes of a flnging head, comprising:

an arcuate forming surface having an appropriate shape to form the desired flange configuration;

a frustoconical supporting and slack-removing surface, having an angle of inclination of between about 60 and 75 degrees, integrally connected to and radially outward of said arcuate forming surface; and an annular curved transition surface, having a radius of between about 0.060 and 0.300 inches, integrally connected to and radially outward of said frustoconical supporting and slack-removing surface.

8. The flanging roller of claim 7 further including a frustoconical guiding surface integrally connected to and radially outward of said annular curved surface.

9. A flanging head for flanging metal thin-walled canbodies having a sidewall thickness of about 0.005 inches and a diameter of between 2.36 and 2.46 inches, comprising:

six flanging rollers; and a rotatable flanging head for said flanging rollers, said six flanging rollers being rotatably mounted on six radial axes equally spaced around the axis of rotation of said flanging head, each of said six flanging rollers having an annulaar curved initial support surface with a radius of between about 0.060 and 0.300 inches and with an annular diameter of about 0.92 inch, the diameter across the flanging head between the annular curved initial support surfaces of opposed flanging rollers being between 2.36 and 2.46 inches.

10. An apparatus for rolling the end of thin-walled canbodies into a flange while minimizing circumferential slippage between the canbody and the rollers over the total contact area, comprising:

a flanging head capable of rotation and longitudinal motion when suitably mounted in a flanging apparatus;

a plurality of rollers rotatably mounted on said flanging head with axes of rotation on radii from a center point and collectively engaging a major portion of the can end, each of said rollers having an arcuate concave forming surface at the inner diameter, a frustoconical slack-removing and supporting surface integrally connected to and outward of said arcuate concave forming surface having an angle of inclination of between 60 and 75 degrees; and a convex transition and clearing surface integrally connected to and outward of said frustoconical surface for smoothly feeding the canbody into the rollers and for providing clearance between the outward diameter portion of the roller and the canbody.

11. A method of providing a flange on the open end of a canbody with a metal thickness of about 0.005 to about 0.008 inch, comprising:

providing relative motion between the open end of the can body and a flanging tool perpendicular to the plane of the open end to place the open end of the can on the flanging tool, contacting the open end of the can first with curved surfaces of the flanging tool, each curved surface having a radius of between 0.300 and 0.060 inch, and supporting the deformable open end of the can over a major portion of its periphery by a plurality of equally spaced portions of the flanging tool while continuing a relative motion urging the canbody and flanging tool together and a relative rotation of the canbody and flanging tool to expand the open can end into a flange, said plurality of portions of the flanging tool being free to rotate about axes lying transverse to the relative rotation of the flanging tool and canbody and supporting said open can end by their frustoconical surfaces both before and after the expansion of the open can end.

* * * * *